US005347247A

United States Patent [19]

Gruchalla

[11] Patent Number: 5,347,247

[45] Date of Patent: Sep. 13, 1994

[54] ELECTRO-OPTIC COMPONENT MOUNTING DEVICE

[75] Inventor: Michael E. Gruchalla, Albuquerque, N. Mex.

[73] Assignee: The United States of America as represented by the United States Department of Energy, Washington, D.C.

[21] Appl. No.: 70,749

[22] Filed: Jun. 2, 1993

[51] Int. Cl.[5] ..... H01P 1/00

[52] U.S. Cl. ..... 333/245; 257/433

[58] Field of Search ..... 333/245-247; 257/98, 99, 432, 433

[56] References Cited

U.S. PATENT DOCUMENTS

| | | | |
|---|---|---|---|
| 3,227,975 | 1/1966 | Hewlett et al. | 333/81 A X |
| 3,354,412 | 11/1967 | Steidlitz | 333/22 R |
| 3,678,417 | 7/1972 | Ragan et al. | 333/22 R |
| 3,739,305 | 6/1973 | Engelmann | 333/81 A |
| 3,775,706 | 11/1973 | Jones et al. | 333/22 R |
| 3,958,195 | 5/1976 | Johnson | 333/247 |
| 4,072,901 | 2/1978 | Mahieu et al. . | |
| 4,240,098 | 12/1980 | Zory et al. | 333/247 X |
| 5,040,998 | 8/1991 | Suzuki et al. | 439/79 |
| 5,047,737 | 9/1991 | Oldfield | 333/22 R |
| 5,093,640 | 3/1992 | Bischof | 333/33 |

*Primary Examiner*—Paul Gensler

*Attorney, Agent, or Firm*—Miguel A. Valdes; Roger S. Gaither; William R. Moser

[57] ABSTRACT

A technique is provided for integrally mounting a device such as an electro-optic device (50) in a transmission line to avoid series resonant effects. A center conductor (52) of the transmission line has an aperture (58) formed therein for receiving the device (50). The aperture (58) splits the center conductor into two parallel sections on opposite sides of the device. For a waveguide application, the center conductor is surrounded by a conductive ground surface (54), which is spaced apart from the center conductor with a dielectric material (56). One set of electrodes formed on the surface of the electro-optic device (50) is directly connected to the center conductor 52 and an electrode formed on the surface of the electro-optic device is directly connected to the conductive ground surface (54). The electrodes formed on the surface of the electro-optic device are formed on curved sections of the surface of the device to mate with correspondingly shaped electrodes on the conductor and ground surface to provide a uniform electric field across the electro-optic device. The center conductor includes a passage (60) formed therein for passage of optical signals to an electro-optic device.

19 Claims, 5 Drawing Sheets

ELECTRO-OPTIC COMPONENT MOUNTING DEVICE

GOVERNMENT RIGHTS

The United States Government has rights in this invention pursuant to Contract No. DE-AC08-88NV10617 between the United States Department of Energy and EG&G Energy Measurements.

TECHNICAL FIELD

This invention relates to techniques for mounting a device such as an electro-optic device, for excitation by an excitation signal.

BACKGROUND ART

In the prior art, devices such as electro-optic components are typically excited through wire connections to respective electrical contact areas of the electro-optic components. Because a connecting wire has inductance, a resonant electrical circuit is formed between the inductance of the connecting wire and the capacitance of the electro-optic device. This resonant electrical circuit limits the maximum useful electrical excitation frequency of the electro-optic device.

An electro-optic component is formed from a suitable electro-optic material and is typically provided with electrical contacts which are deposited on its surface for application of appropriate electrical modulation signals. The material of a typical electro-optic device has a comparatively high dielectric constant so that the device presents a high-capacitance load to an electrical excitation source. This high capacitance causes serious difficulties in communication of high-performance, i.e., high-frequency, signals to the electro-optic device.

This communication of electrical excitation signals to an electro-optic device is often made more difficult by the unusual physical configuration or construction of such devices, such as, for example, quadrapole and octapole structures.

The most common interconnection practice in the prior art for driving electro-optic devices and other types of devices is to use simple wire connections provided by interconnecting wires. Because each of the connecting wires has a series inductance, a series resonant electrical circuit is formed with the inductance of a connecting wire and the capacitance of the device. This series resonant electrical circuit limits the maximum useful electrical excitation frequency of the device. Even if the connecting wires are made as short as practical, some inductance is still present in the connecting wire. For example, if the total length of a connecting wire is nominally 1 cm. and is positioned near a ground plane, the inductance will be on the order 10 nH. Typical electro-optic elements have capacitances of several thousand picofarads. With several nanohenries of wire inductance and several thousand picofarads of device capacitance, a series resonance occurs at a frequency in the range of 10MHz to 100MHz. In general, a device with this type of connection is limited to operation below that resonant frequency.

For a device having relatively high capacitance to operate at higher frequencies, either the series resonance must be shifted to a frequency above the maximum frequency of interest, or the series resonances must simply be eliminated. The only way to shift a series resonance to a higher frequency is to decrease either the series inductance or the capacitance of an electro-optic device. Since the capacitance of the device is an inherent physical characteristic, it cannot be altered. In practice, the series inductance of a lead cannot be changed by more than a small amount because of the physical length required for the simple wire connection.

Consequently, a need exists for a technique to make a better connection for an electrical excitation signal to a device such as an electro-optic device in order to substantially eliminate or significantly reduce series resonance effects.

DISCLOSURE OF THE INVENTION

It is therefore an object of the invention to provide an improved technique for mounting a component device such as an electro optic device so that precision, wide-bandwidth electrical signals can be more effectively applied to the device.

The present invention reduces the effect of the electrical resonant circuit formed between a component and its signal-communicating structures by incorporating the component into a transmission-line structure. The present invention makes possible operation of components such as electro optic at very high frequencies, perhaps in excess of 20 GHz. Such operating frequencies are much higher than those available using the component mounting techniques and exciting structures of the prior art so that the present invention provides a significant improvement over the prior art for electrical modulation of components such as electro-optic devices.

The present invention provides for delivery of high-frequency electronic drive signals to an electronic device. More specifically, the present invention is intended to deliver high frequency electronic excitation to an electro-optic device.

The present invention overcomes the deficiencies of the various interconnections techniques of the prior art, such as the simple wire connection, by integrating the device to be excited into a transmission-line structure. The series impedance between a signal source and the excited device is then purely resistive by virtue of the characteristics of a transmission line. If the transmission line is properly terminated at least at one end, either at the source end or at the device end, there will be no standing-wave reflections. The driving source impedance, including all of the connections to the excited device, is totally resistive. The purely resistive nature of the connections to the excited device eliminates the series resonance effects referred to herein above. This allows operation of an electro-optic device at very high frequencies to be limited primarily by the losses in the materials of the transmission line structure. With common materials, such as aluminum or copper conductors, and with dielectric material such as polyethylene or air dielectric, operation to greater than 10 GHz can be obtained.

The present invention provides apparatus for integrally mounting an electro-optic device in a transmission line. Electrodes are formed on the surface of the device. The transmission line includes a center conductor fixed with respect to a conductive ground surface which can surround the center conductor. A dielectric material is located between the conductive ground surface and the center conductor. The center conductor has an aperture formed therein for receiving the electro-optic device. Means are provided for making a direct electrical connection between some of the electrodes formed on the surface of the device and the center conductor. Means are also provided for making a direct electrical connection between one or more other electrodes formed on the surface of the device and the conductive ground surface.

At least a part of the center conductor is split longitudinally into two spaced-apart sections with the aperture formed therebetween so that the electro-optic device has a respective one of the two spaced-apart sections on either side. The aperture between the two sections can extend for a distance substantially greater than the length of the electro-optic device along the direction of the center conductor.

The direct connections to the electrodes formed on the surface of the device by the section of the center conductor can be made with solder or pressure contact. One or more ground terminals are formed on the ground surface for connection to electrodes formed on the surface of the device. In one embodiment of the invention, the electrodes formed on the surface of a device are formed on curved sections of the surface of the electro-optic device and the center conductor and ground surface includes correspondingly curved surfaces to mate with the electrodes on the device to provide a uniform electric field across the electro-optic device.

The conductive ground surface can be the interior surface of a wave guide which has a rectangular cross-section. The electro-optic device can be a multi-pole device such as quadrapole, sextapole, or octapole with a center conductor which has an appropriate aperture and connection surface formed therein.

The center conductor includes a passage formed therein for passage of optical signals to the electro-optic device. Alternatively, the space between the split sections of a center conductor can provide a passage for optical signals to the device.

The invention is not necessarily limited to an electro-optic device. It is applicable to any device that is excited with high frequency or high fidelity electro magnetic signals.

A method is provided according to the invention for integrally mounting an electro-optic device in a transmission line structure. The method includes the steps of: forming an aperture in a center conductor of a transmission line having a conductive ground surface spaced apart with a dielectric material from the center conductor; placing the electro-optic device in the aperture formed in the center conductor; directly connecting the center conductor to at least two electrodes formed on the surface of the electro-optic device; directly connecting the conductive ground surface to at least one other electrode formed on the surface of the electro-optic device.

The present invention provides a technique for communicating high-performance excitation signals to devices such as electro-optic elements. The present invention is not limited to electro-optic devices. The basic transmission-line technique of the present invention may be applied to provide electronic excitation to various other types of devices. Because a transmission-line signal utilizes both an electric and a magnetic field, the present invention is applicable to deliver high-performance excitation signals to both electrically-excited and magnetically-excited devices. Because the invention embeds the device in a transmission line, rather than in a series resonant circuit, impedance mismatches in the transmission line can be controlled, in contrast to the series resonances in the prior art connection systems cannot be controlled.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
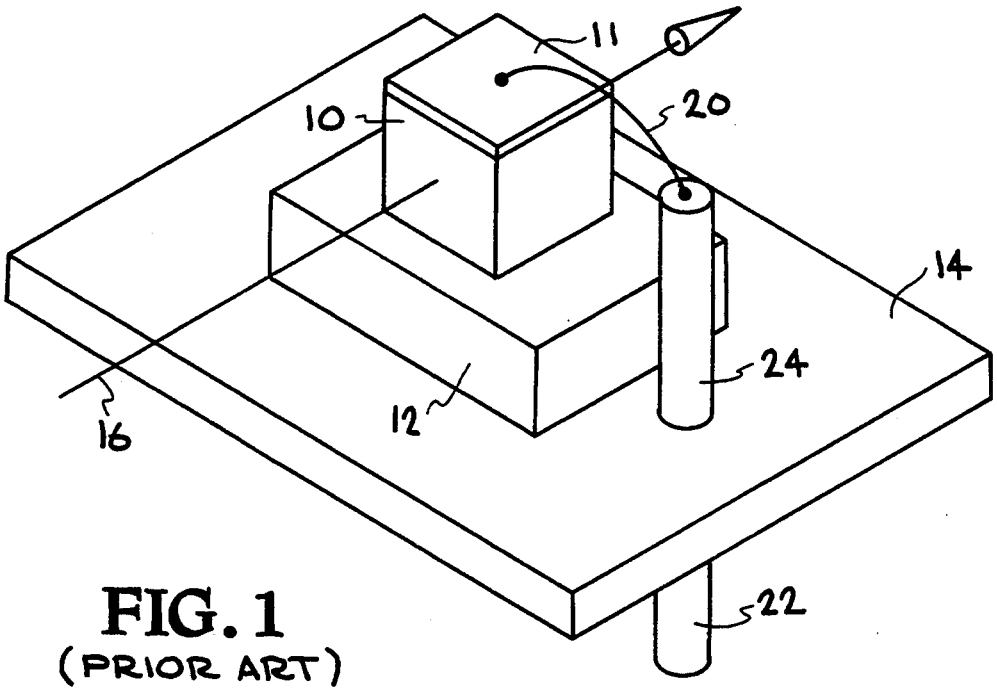
FIG. 1 (PRIOR ART)
FIG. 1 is an isometric view showing a commonly used prior-art system for making electrical connections to an electro-optic device.

FIG. 1 shows a prior-art technique for making connections to an electro-optic device 10, which is shaped as a rectangular block of appropriate electro-optic material. The bottom surface of the electro-optic device 10 is fixed to a conductive mounting platform 12. The conductive mounting platform 12 is fixed to a ground plane 14, which, for example, forms part of the enclosure or case for the electro-optic device 10. An optical signal is transmitted along an optical axis 16 for the electro-optic device 10. The top surface 11 of the electro-optic device 10 is metallized to form a contact surface for one end of a length of bonding wire 20. The other end of the length of bonding wire 20 is connected, for example, to the center conductor of a coaxial conductor 22 which has a cylindrical, conductive outer shield 24. The coaxial conductor 22 extends through the ground plane 14. The outer shield 24 of the coaxial conductor 22 is connected to the ground plane 14

Because the length of bonding wire 20 has a significant amount of series inductance, a series resonant electrical circuit is formed with the inductance of the length of bonding wire and the capacitance of the electro-optic device 10. A mentioned previously this series resonant electrical circuit limits the maximum useful electrical excitation frequency of the electro-optic device, even if the connecting wires are made as short as practical. Since the capacitance of the electro-optic device 10 is essentially fixed and the series inductance of a lead cannot be changed by more than a small amount because of the physical length required, operation of such a circuit is severely limited to below the series resonant frequency of the connection circuit.

Figure 3:
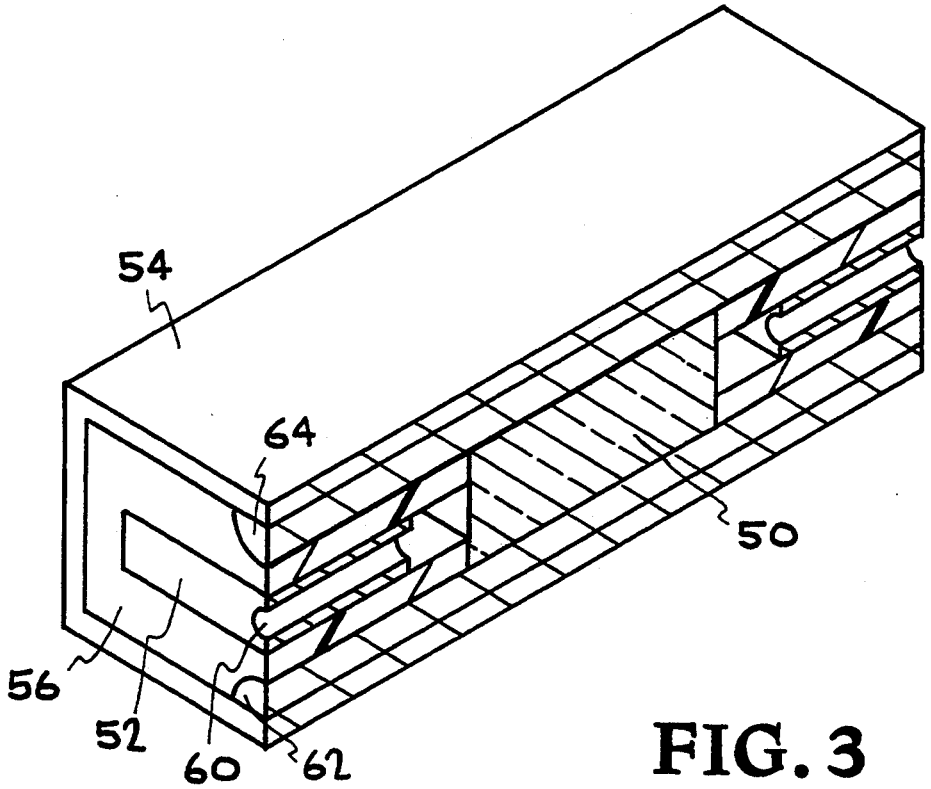
FIG. 3 is an isometric, longitudinal sectional view of the structure of FIG. 2 taken along section line 3—3 of FIG. 2.
Figure 4:
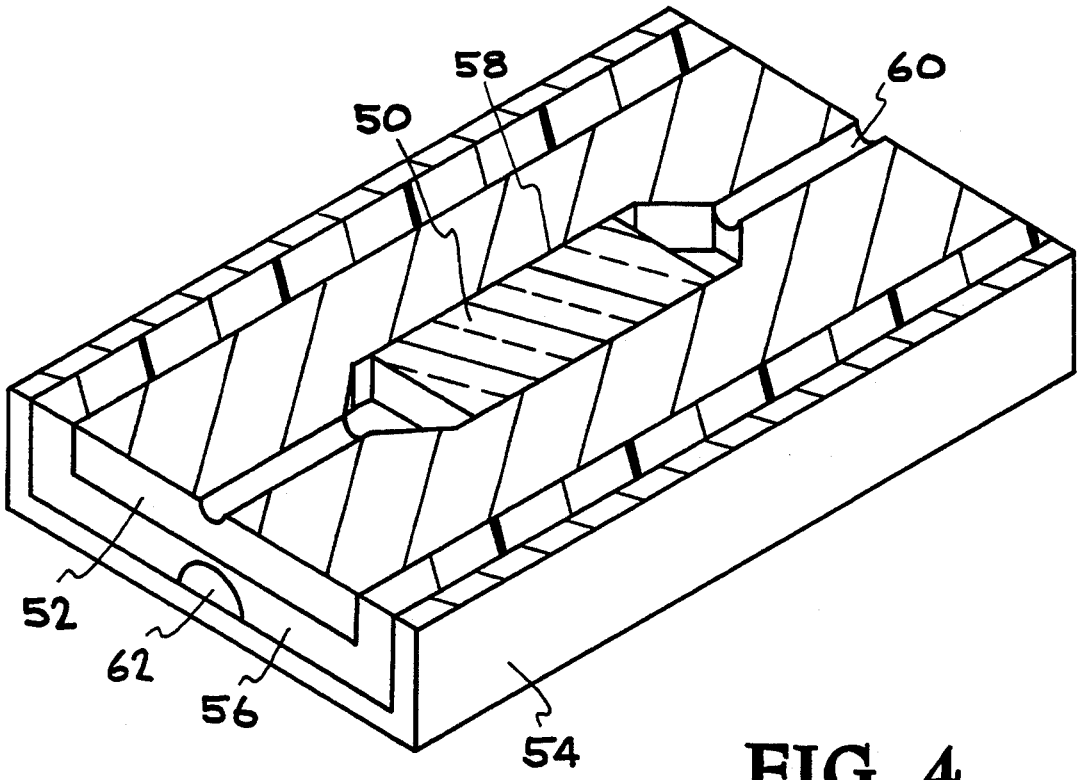
FIG. 4 is an isometric, lateral sectional view of the structure of FIG. 2 taken along section line 4—4 of FIG. 2.
Figure 5:
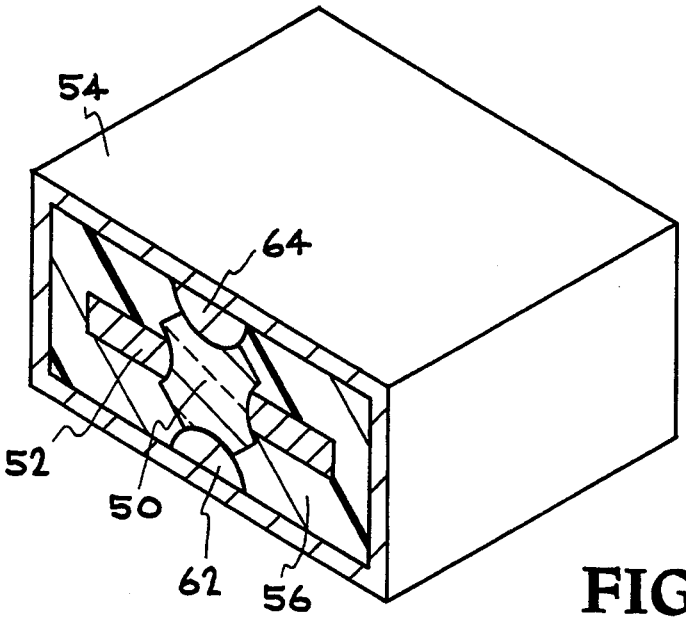
FIG. 5 is an isometric, sectional view of the structure of FIG. 2 taken along section line 5—5 of FIG. 2.
Figure 6:
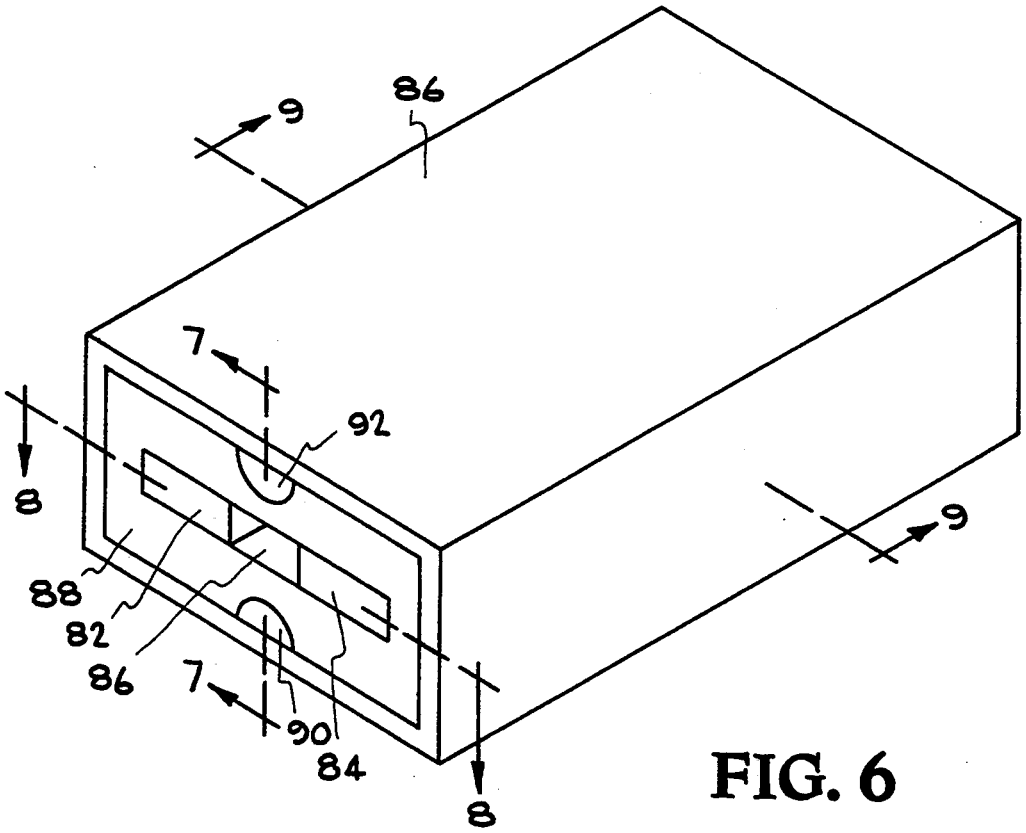
FIG. 6 is an isometric, sectional view of one portion of rectangular coaxial transmission structure having two longitudinally split central conductors between portions of which is positioned a quadrapole electro-optic device according to the invention.
Figure 7:
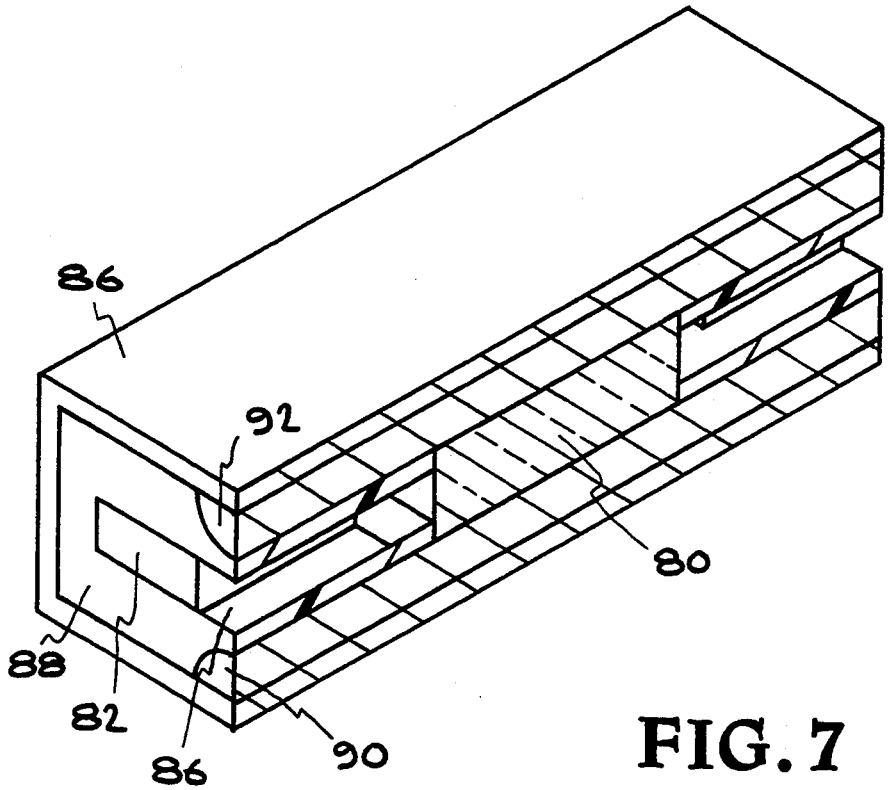
FIG. 7 is an isometric, longitudinal sectional view of the structure of FIG. 6 taken along section line 7—7 of FIG. 6.
Figure 8:
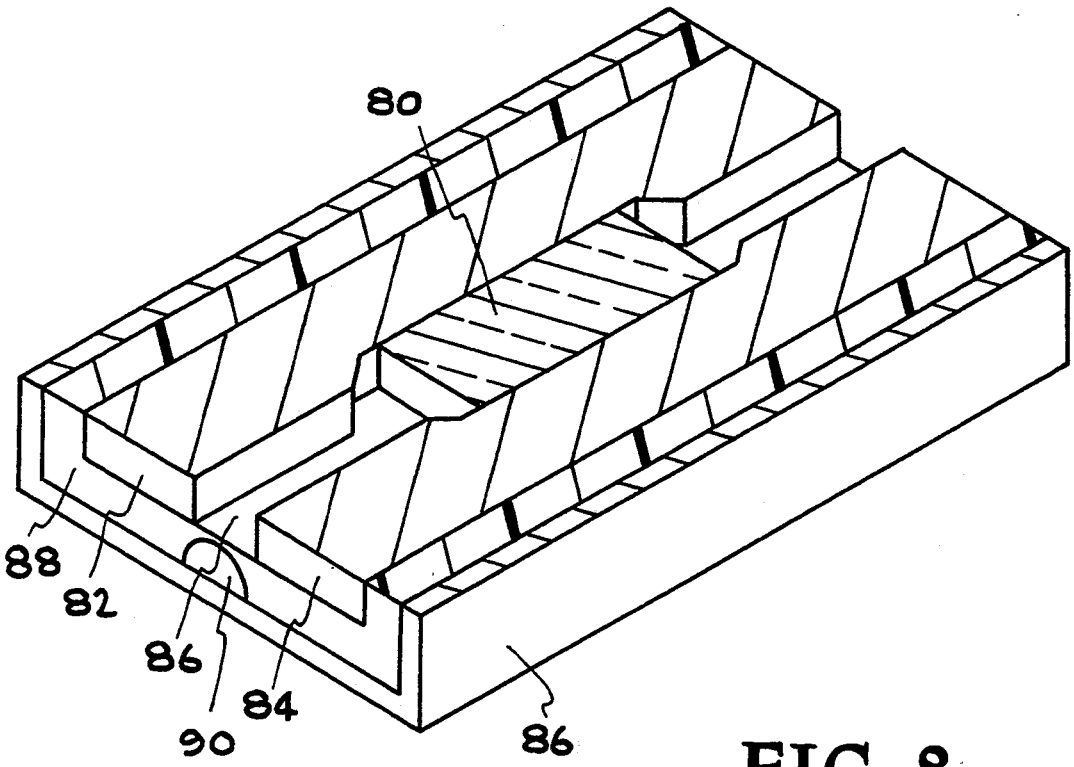
FIG. 8 is an isometric, lateral sectional view of the structure of FIG. 6 taken along section line 8—8 of FIG. 6.
Figure 9:
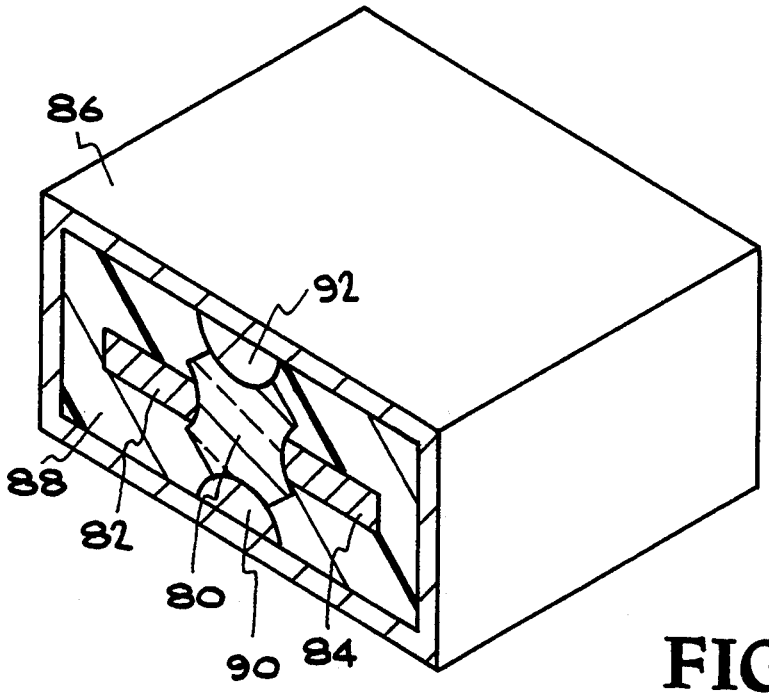
FIG. 9 is an isometric, sectional view of the structure of FIG. 6 taken along section line 9—9 of FIG. 6.

FIGS. 2, 3, 4, and 5 show various views of one embodiment of a mounting system for an electro-optic device 50, according to the invention. The electro-optic device 50 in this embodiment has a quadrapole, or winged, structure as illustrated in FIG. 5.

Figure 2:
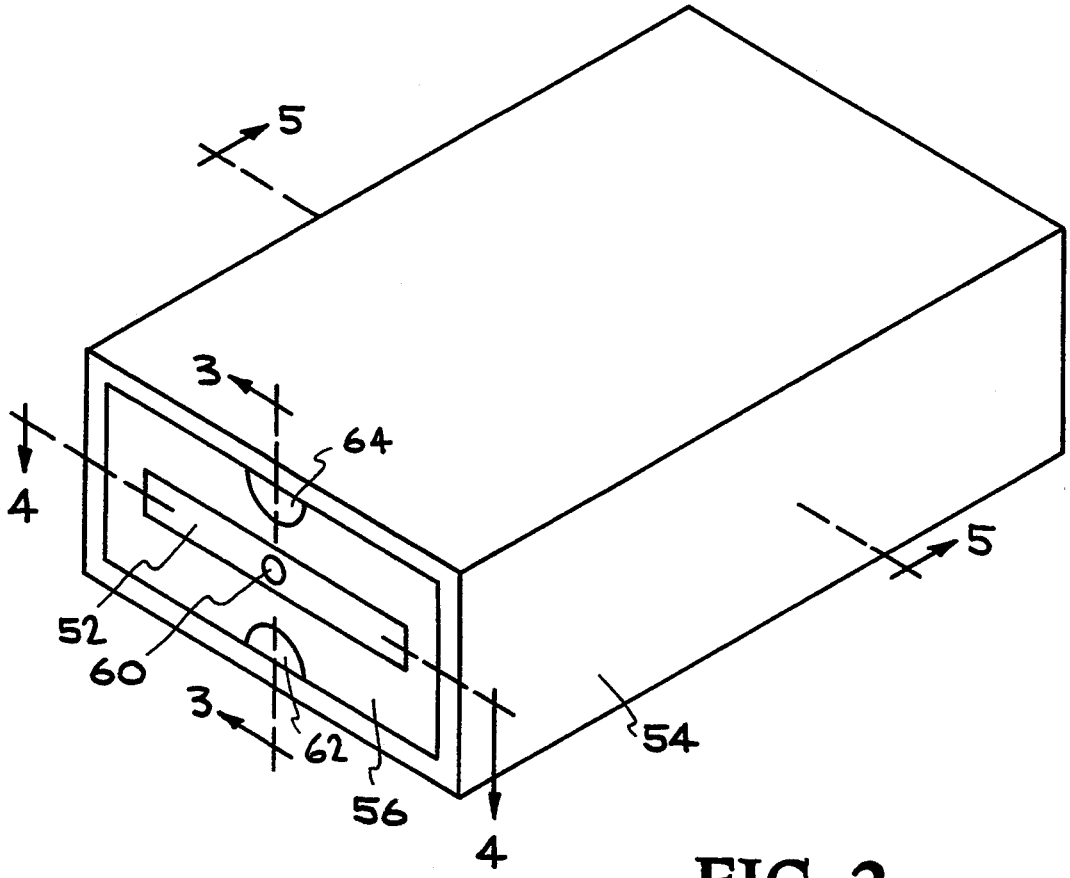
FIG. 2 is an isometric, sectional view of one portion of a rectangular coaxial transmission structure having a single central conductor in which is embedded a quadrapole electro-optic device, according to the invention.

FIGS. 2 and 4 illustrate a transmission line structure which comprises a rectangular coaxial transmission-line structure having a strip center conductor 52 and a rectangular conductive surround 54 with a suitable dielectric layer 56 therebetween, as illustrated. The rectangular conductive surround 54 is typically grounded.

FIGS. 3 and 4 show that the electro-optic device 50 or other type of device to be excited is placed, or embedded, in an aperture 58 formed in the center conductor 52. In this manner, an electric field is developed in the excited electro-optic device 50 between the center conductor 52 and the grounded rectangular conductive surround 54. Note that this type of physical structure is useful in applying an exciting field to an excited device which has a quadrapole structure. However, similar transmission-line structures can also be used to excite devices having other physical structures, such as, for example, dipole, sextapole and octapole structures.

The aperture 58 formed in the center conductor of the strip-line transmission line is configured to provide the necessary mechanical configuration to mount the electro-optic device. In the case of a simple quadrapole electro-optic component comprising a substantially square cross section with contacts fashioned on each longitudinal face, the aperture could have substantially parallel sides to complement the dimensions of the electro-optic device.

The electro-optic device 50 has a plurality of electrodes formed on the surfaces thereof. Connecting the electro-optic device to the center conductor includes various means such as solder or pressure contacts. Resilient contacts could be used or the center conductor could be split longitudinally to allow the center conductor to be assembled about the electro-optic component. The conducting surround has dimensions to accommodate contact to the corresponding electrodes of the electro-optic component as illustrated in FIG. 5. The mechanical configuration of the present invention can be designed to accommodate electro-optic components having a very broad range of geometries. For example, by suitable shaping of the contacting surfaces, a quadrapole electro-optic component having curved electrode geometry is accommodated as illustrated in FIG. 5.

Connections between the electro-optic device 50 and the conductive surround include areas formed on the raised surfaces of inwardly raised portions 62, 64 of the conductive surround. The raised portions can extend beyond the electro-optic device, as shown, or be provided only near the device, if desired. Note that the raised portions 62, 64 can be adjusted in their height and length to control the impedance of the transmission line, if desired.

A preferred method of contacting the electro-optic device is with a pressure electrical contact in which the electro-optic crystal device has a metalization layer formed on its surface. Pressure between the conductor and the metalization layer forms an electrical connection. A fuzz button can be used to make connections, where a fuzz button is made of a conductor such as gold or silver plated wire in a construction similar to a piece of steel wool.

The contacting surface of the electro-optic device can be curved to provide a uniform field in the electro-optic device. This curved connection would be particularly useful for lower dielectric constant materials, such as Lithium Niobate which has a dielectric constant of 6 so that just surface contact, and no soldering, is required for a good connection to this type of material.

An axial hole 60 extends along the center axis of the center conductor 52 as illustrated in FIGS. 2, 3, and 4. The axial hole 60 permits line-of-sight access to the excited electro-optic device 50 for optical signals processed with the electro-optic device 50. The hole 60 extends down the center of the center conductor and provides a passageway for the light beam which impinges on the electro-optic crystal, or device. A turning mechanism may be required to steer a light beam into the axial hole 60. A prism or turning mirror can be used to do this function at, for example, a 45 degree bend in the center conductor.

When an electrical signal is applied to an input terminal of the transmission line, an electromagnetic signal wave is transmitted along the center conductor of the transmission line structure toward the electro-optic device 50. Because the electro-optic device 50 has a much higher capacitance than dielectric layer 56, the impedance of the transmission-line structure is altered in the section of transmission line where the electro-optic device is embedded. Therefore, when the electromagnetic signal wave arrives at the electro-optic device 50 to be excited, a reflection occurs which directs some of the electromagnetic wave energy back toward the input terminal-end of the transmission line. If the signal source driving the input terminal has a source impedance equal to that of the transmission line, the reflected signal will be properly terminated and no secondary reflection will occur back on line from the input termination. Such a configuration is termed a "reverse termination" since the reverse-propagating signal components are properly terminated. With proper reverse termination no standing wave signals are formed on the transmission line even though there is a disturbance in the line impedance at the electro-optic device 50.

In the section of transmission line which includes the electro-optic device 50,.the dielectric constant of the excited device significantly alters the line impedance. Because the electro-optic device 50 has a higher dielectric constant than the dielectric constant of the basic, undisturbed transmission line, the impedance of the transmission line at the electro-optic device 50 is lower. However, it is important to note that even though the line impedance is altered in the vicinity of the electro-optic device 50, the structure near the electro-optic device still remains a true transmission-line structure. Consequently, the electro-optic device 50 is excited through a true resistive impedance with no parasitic series inductance.

Therefore, even though the impedance of the transmission line may be altered in the vicinity of the electro-optic device, the full bandwidth of the transmission-line structure is preserved. This is a very significant improvement over the simple wire connections used in the prior art for excitation of such devices.

In the case where the dielectric constant of the basic transmission-line structure is chosen-to approximately match the dielectric constant of the electro-optic device, an embodiment of the present invention is obtained which has substantially constant impedance along its entire line length, even including the segment in which the electro-optic device is embedded. Such a configuration minimizes reflections, resulting in a higher signal level being available at the electro-optic device. This also allows a higher signal level to be communicated beyond the excited device for further uses, such as, for example, exciting additional electro-optic devices.

In operation, in the structure according to the present invention, an electrical signal is launched at one end of the strip-line transmission line structure. Because the mechanical structure of the present invention provides a properly configured transmission-line structure, the applied signal propagates along the transmission line of the present invention with very low loss and very low distortion. When the signal reaches the electro-optic component entertained in the strip center conductor, the opposing electrodes in contact with the center conductor are held at identically the same potential both by the symmetry of the structure and by the electrical continuity across the center strip conductor.

FIGS. 6, 7, 8, and 9 show an alternative embodiment of a transmission line structure for mounting an electro-optic device 80, according to the invention. The transmission-line structure includes a rectangular coaxial transmission-line structure having a split center conductor, which includes two coplanar conductors 82, 84 placed side-by-side with a small gap 94 provided therebetween, where the gap extends beyond the vicinity Of the device 80. The gap allows optical access to the electro-optic device 80. A rectangular conductive surround 86 is provided with a suitable dielectric layer 88 therebetween, as illustrated. The rectangular conductive surround 86 is typically grounded. The split conductors 82, 84 can be electrically isolated so that signals of different phases can be applied to opposite sides of a device to excite each side of a device independently. The gap between the conductors 82, 84 could be air or other suitable dielectric material in selected regions.

This transmission line structure with a split center conductor provides line-of-sight access to the excited element. In such a configuration, the two elements of the center conductor are normally driven equipotentially with respect to each other from a common source. However, in another variation of this embodiment, each of the conductors 82, 84 of the split center conductor is driven with a different signal to provide whatever functional performance is needed in a particular application. Although only two center-conductor elements are shown in the embodiment of FIGS. 6–9, more than two individual center-conductor elements could be used. For example, in the case of an octapole device excited, four center-conductor segments could be utilized. In an application such as an octapole device, a combination of a single center-conductor element and split center-conductor elements can also be used.

Connections between the opposite surfaces of the device 80 and the conductive surround 86 are made through raised positions 90, 92 of the conductive surround. The raised portions can extend along the length of the conductive surround or be provided only near the device as desired.

Figure 10:
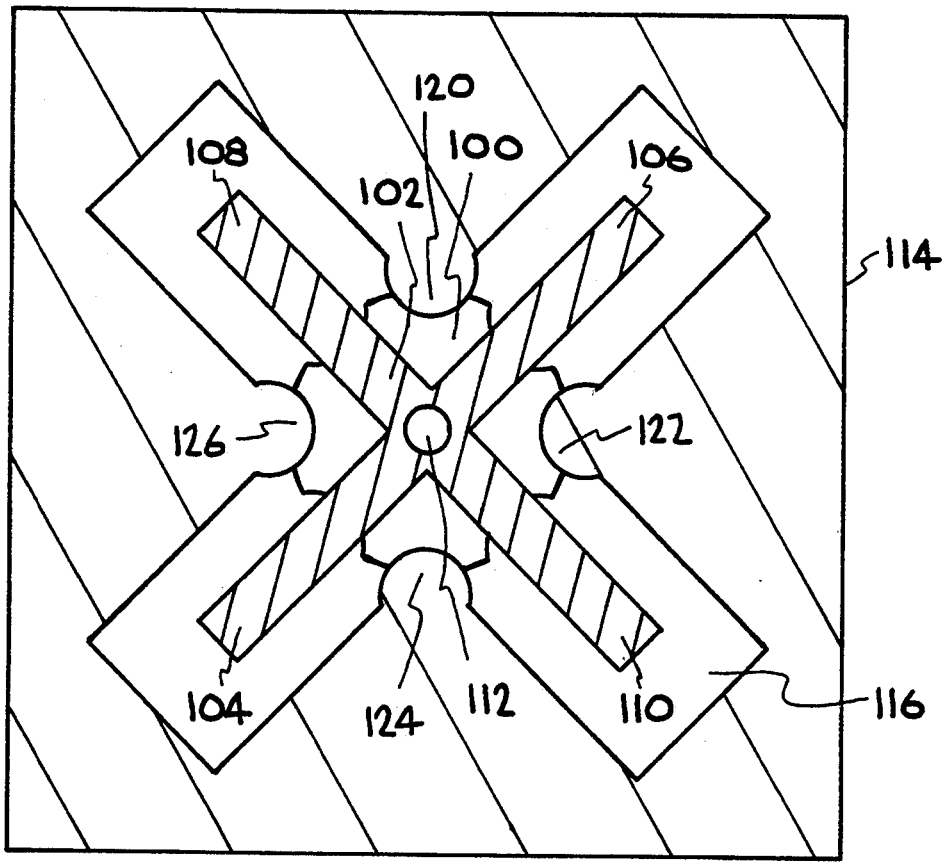
FIG. 10 is a sectional view of a rectangular transmission structure for holding an octapole electro-optic device.

FIG. 10 shows a sectional view of a further embodiment of the present invention which is configured as a transmission line for excitation of an electro-optic device octapole structure 100. The transmission line includes a center conductor 102 which is formed of two mutually perpendicular conductive strips having respective oppositely extending arms 104, 106 and 108, 110. An axial hole 112 extends along the center axis of the center conductor 102 to provide line-of-sight access to the electro-optic device 100. Alternatively, the elements of the center conductor could be split into several parallel segments as previously described herein above. The arms of the center conductor 102 are spaced apart from an appropriately configured and grounded, conductive surround 114 by means of a dielectric layer 116. Projecting portions 120, 122, 124, 126 of the conductive surround 114 contact the four "ground" faces of the device 100.

One electro-optic material useful with the structure of the present invention is Strontium Barium Niobate (SBN) 65 or 75, which is a high dielectric material (500 to 10,000). It is used in a streak camera in which a light beam is swept by a fast electrical control signal. The brightness of the beam is converted to a signal amplitude in the CCD display. This allows for high frequency recording of fast events.

The center conductor is typically formed from a conductive material, such as a metallic material. The conductive surround is also formed from a conductive-material, but is not necessarily formed from the same material as that of the center conductor. The dielectric layers are formed of a suitable insulating material. Common insulating materials are air, vacuum, some type of plastic material, ceramic, or crystalline material.

In general, the introduction of the electro-optic component into the strip-line transmission line structure will result in a local compromise of the transmission-line impedance which is accommodated by the present invention. Because the basic structure of the present invention is a true transmission line, it exhibits a characteristic impedance that may be manipulated by appropriate design of the mechanical parameters, as is common in the art of transmission lines. Therefore, if the transmission line according to the present invention is driven from a source exhibiting an impedance equal to the characteristic impedance of the transmission-line according to the present invention, any signals traveling in reverse to that launched, for example reflections from the impedance discontinuity at the electro-optic component site, will be properly terminated (reverse termination) and will not result in objectionable standing waves. Similarly, the transmission-line structure according to the present invention may be extended beyond the site of the electro-optic component and terminate in a matched forward termination. The providing of both forward and reverse terminations according to the present invention results in high fidelity in the signal actually applied to the electro-optic component and substantially eliminates any objectionable standing-wave effects.

If the electro-optic component is placed at the end of the transmission-line according to the present invention, the transmission-line structure need not be forward terminated. In such a case, the signal propagation along the transmission line encounters an open circuit at the line end at the site of the electro-optic component. Upon encountering such an open circuit condition, the line voltage will double and a voltage signal will be reflected back in the reverse direction along the transmission-line structure back to the signal source. If the signal source is properly terminated, the reflected signal is absorbed and no further reflections will occur. Such an open-circuit configuration can provide a doubling of the line voltage to provide a higher excitation level for the electro-optic component in those applications where a higher level of voltage excitation is required.

In practice, the physical transmission-line structure can be continued beyond the excited device, if required. For example, the transmission line can be run to a second device and on to even more additional devices in a similar manner to thereby provide for excitation of multiple devices located in the transmission-line structure. Alternatively, the transmission line could be extended to a matched load impedance to provide a high performance termination of the transmission line. Similarly, the transmission line could be extended to diagnostic equipment to allow the actual exciting signals being delivered to the excited device to be observed.

The present invention is not limited to the particular transmission-line structures described above which is a preferred embodiment for specific applications. Other suitable transmission-line structures include, but are not limited to: micro-striplines, circular coaxial transmission lines, square and rectangular coaxial transmission lines, coplanar lines, and parallel open-conductor lines.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. Apparatus for integrally mounting an electro-optic device in a transmission line, comprising:

a plurality of electrodes formed on the surface of the electro-optic device;

a conductor having an aperture formed therein for receiving the electro-optic device;

a conductive ground surface spaced apart from and surrounding said conductor;

means for making a direct electrical connection between the center conductor and electrodes formed on the surface of the electro-optic device;

means for making direct electrical connections between one or more electrodes formed on the surface of the electro-optic device and the conductive ground surface;

dielectric material located between the conductive ground surface and the center conductor.

2. The apparatus of claim 1 wherein the center conductor is split longitudinally into two spaced-apart sections with the aperture formed therebetween.

3. The apparatus of claim 2 wherein the aperture extends between the two spaced-apart sections for a distance substantially greater than the length of the electro-optic device along the direction of the center conductor.

4. The apparatus of claim 1 wherein the means for connecting some of the plurality of electrodes formed on the surface of the electro-optic device to the center conductor includes solder connections.

5. The apparatus of claim 1 wherein the means for connecting some of the plurality of electrodes formed on the surface of the electro-optic device to the center conductor includes pressure contact means.

6. The apparatus of claim 1 wherein the means for connecting some of the plurality of electrodes formed on the surface of the electro-optic device to the conductive ground surface includes a plurality of ground terminals formed on the ground surface and connected to respective others of the plurality of electrodes formed on the surface of the electro-optic device.

7. The apparatus of claim 1 wherein the conductive ground surface is the interior surface of a conductive surround.

8. The apparatus of claim 7 wherein the conductive surround has a rectangular cross-section.

9. The apparatus of claim 1 wherein the electro-optic device is a quadrapole device having four electrodes formed on the surface thereof.

10. The apparatus of claim 1 wherein the electro-optic device is an octopole device.

11. The apparatus of claim 1 wherein the electrodes formed on the surface of the electro-optic device are formed on curved sections of the surface of the electro-optic device and wherein the center conductor includes correspondingly curved surfaces to mate with the electrodes on the electro-optic device to provide a uniform electric field across the electro-optic device.

12. The apparatus of claim 1 wherein the center conductor includes a passage formed therein for passage of optical signals to the electro-optic device.

13. The apparatus of claim 12 wherein the passage formed in the center conductor extends along the length of said center conductor.

14. Apparatus for integrally mounting for excitation with a high-fidelity electro-magnetic signal, comprising:

a conductor having at least a portion of which is split longitudinally into two spaced-apart parallel sections with an aperture formed therebetween for receiving an electro-optic device;

a conductive ground surface spaced apart from said conductor;

dielectric material located between the conductive ground surface and the conductor;

means for directly connecting electrodes formed on the surface of the electro-optic device to the two spaced-apart parallel sections of the center conductor;

means for directly connecting an electrode formed on the surface of the electro-optic device to the conductive ground surface.

15. The apparatus of claim 14 wherein electrodes formed on the surface of the electro-optic device are formed on curved sections of the surface of the electro-optic device and wherein the center conductor includes correspondingly curved surfaces to mate with the electrodes on the electro-optic device to provide a uniform electric field across the electro-optic device.

16. The apparatus of claim 14 wherein the device is an electro-optic device.

17. The apparatus of claim 15 wherein a passage is provided in the conductor for passage of optical signals to the electro-optic device.

18. The apparatus of claim 14 wherein the center conductor is formed of two independent space-apart parallel sections which form a split center conductor.

19. A method of integrally mounting an electro-optic device in a transmission line structure, comprising the steps of:

forming an aperture in a center conductor of a transmission line having a conductive ground surface spaced apart with a dielectric material from the conductor;

placing an electro-optic device in the aperture formed in the center conductor;

directly connecting the center conductor to at least two electrodes formed on the surface of the electro-optic device;

directly connecting the conductive ground surface to at least one other electrode formed on the surface of the electro-optic device.

* * * * *